US006161220A

United States Patent [19]

Crisp

[11] Patent Number: 6,161,220

[45] Date of Patent: Dec. 19, 2000

[54] INSULATING GARMENT

[75] Inventor: Barbara Anne Crisp, Granville Summit, Pa.

[73] Assignee: Dear Fanny Co., Inc., Granville Summit, Pa.

[21] Appl. No.: 09/466,274

[22] Filed: Dec. 17, 1999

[51] Int. Cl.[7] ..... A41D 13/04

[52] U.S. Cl. ..... 2/48; 2/467

[58] Field of Search ..... 2/48, 456, 455, 2/458, 467, 51, 92, 94, 214, 231

[56] References Cited

U.S. PATENT DOCUMENTS

| | | | |
|---|---|---|---|
| 932,990 | 8/1909 | Madill et al. | 2/51 |
| 1,099,875 | 6/1914 | Fuiks | 2/94 |
| 1,195,523 | 8/1916 | Sonnenberg | 2/51 |
| 1,404,987 | 1/1922 | Lundqvist | 2/51 |
| 1,711,611 | 5/1929 | Mock | 2/214 |
| 2,661,474 | 12/1953 | Tate | 2/94 |
| 2,736,030 | 2/1956 | Moody | 2/94 |
| 2,762,054 | 9/1956 | Smith | 2/227 |
| 3,185,362 | 5/1965 | Wakefield | 224/9 |
| 3,665,517 | 5/1972 | Hyman | 2/84 |
| 3,708,799 | 1/1973 | Smithdeal | 2/46 |
| 3,731,321 | 5/1973 | Dyche | 2/211 |
| 4,255,817 | 3/1981 | Heim | 2/2 |
| 4,459,703 | 7/1984 | Kosmas | 2/48 |
| 4,833,731 | 5/1989 | Foxman | 2/48 |
| 4,837,859 | 6/1989 | Hamberg | 2/2 |
| 4,993,077 | 2/1991 | Robison | 2/82 |
| 5,038,408 | 8/1991 | DeBaene | 2/23 |
| 5,052,055 | 10/1991 | Mysliwiec | 2/48 |
| 5,068,920 | 12/1991 | Bray | 2/21 R |
| 5,275,315 | 1/1994 | Carmack et al. | 224/151 |
| 5,295,267 | 3/1994 | Galindo | 2/2 |
| 5,398,667 | 3/1995 | Witt | 126/263 |
| 5,491,843 | 2/1996 | Naughton | 2/48 |
| 5,557,801 | 9/1996 | Jakus | 2/2 |
| 5,625,895 | 5/1997 | Soverign | 2/467 |
| 5,673,836 | 10/1997 | Bush | 224/576 |
| 5,909,802 | 6/1999 | Puco et al. | 2/102 |
| 6,041,437 | 3/2000 | Barker et al. | 2/82 |
| 6,041,447 | 3/2000 | Endler | 2/455 |

OTHER PUBLICATIONS

Dear Fanny Co. (assignee of this application) Web Site www.sosbbs.com/DearFanny Co.

*Primary Examiner*—John J. Calvert
*Assistant Examiner*—Alissa L. Hoey
*Attorney, Agent, or Firm*—Brown, Pinnisi & Michaels, P.C.

[57] ABSTRACT

A wrap-around insulating garment for the thigh and buttocks region. The garment, similar to a kilt, is worn over the clothes, and serves to insulate the buttocks and thigh regions from cold and wet weather. The garment has a cutaway in the front which allows the wearer to easily raise his legs and assume a sitting position. An inverted v-shaped cut, smaller in width than the cutaway, is found directly above the cutaway, which allows for a larger range of motion for the wearer during use.

12 Claims, 3 Drawing Sheets

INSULATING GARMENT

FIELD OF THE INVENTION

The invention pertains to the field of clothing. More particularly, the invention pertains to insulating garments worn about the waist.

BACKGROUND OF THE INVENTION

One of the problems that exist for people who enjoy the outdoors in the winter is staying warm without sacrificing comfort. The buttocks region is especially sensitive to the cold weather. This problem is particularly prevalent for hunters who are required to remain still for long periods of time in the coldest of weather.

Prior art garments which attempted to protect the buttocks region from the elements include a garment which is similar to a mini-skirt. This garment utilizes a lightweight fleecelike material. Fleece or other materials are used to make the garment, thus providing insulation for the wearer. In effect, the garment is an insulating tube worn around the hips area. This garment insulates a person's thigh and buttocks region. It easily fit over pants, and is used to keep an individual warm during cold weather activities. However, the range of movement of the individual, specifically raising the legs to sit down, is compromised by this garment during use.

The garment discussed above has been modified with a split up the front which allows for the placement of a zipper or hook and loop fabric fastener material, such as VELCRO™. This additional facet of the garment makes it easier to get in and out of the garment. However, by unfastening the garment, which may be done in order for an individual to raise his legs to assume a sitting position, the wearer lets in the cold air, and the garment is no longer fully insulating the individual.

The prior art garments lack the ability to provide insulation and warmth, while at the same time, provide comforts such as the ability to raise one's legs to assume a sitting position. Legs can not be comfortably raised using the garments in the prior art, making it uncomfortable to sit while wearing them. Also, a garment which allows a man to relieve himself without removing or unfastening the garment is not available in the prior art, and the dress-like appearance of these garments limits the appeal to the male consumer.

Although there are outerwear garments that attempt to insulate an individual from the harsh realities of the weather, these garments are often uncomfortable and restrictive to the wearer. Therefore, a need exists for a more comfortable, less restrictive garment to be worn around the waist for insulation.

SUMMARY OF THE INVENTION

Briefly stated, the present invention is a garment which insulates the thigh and buttocks region. The garment is worn over the clothes, and serves to insulate the buttocks and thigh regions from cold and wet weather. The garment specifically contains a cutaway in the lower portion of the front which allows the wearer to easily raise his legs and assume a sitting position. An inverted v-shaped cut, smaller in width than the cutaway, is found directly above the cutaway, which allows for a larger range of motion for the wearer during use.

DESCRIPTION OF THE PREFERRED EMBODIMENT

Figure 1:
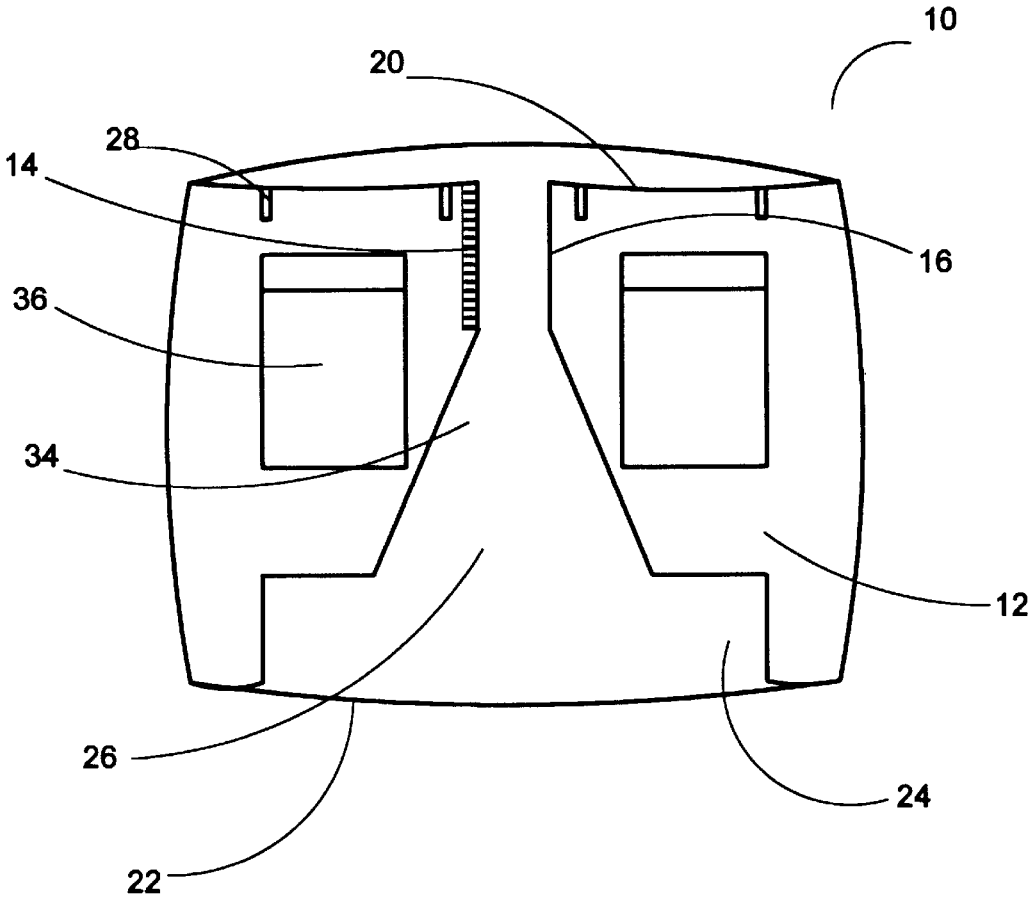
FIG. 1 shows a front view of the garment of the present invention.

Referring to FIG. 1, a front view of the insulating garment (10) is shown. The garment is similar to a kilt in basic structure, except for the opening in front, described in more detail below. The insulating garment (10) wraps around the pelvic region, extending vertically from the waist area to close to the knees. The exact length of the insulating garment (10) is not essential, as long as the insulating garment (10) effectively covers the entire buttocks of the wearer. The insulating garment (10) is typically worn outside the clothing, and is designed to fit easily over jeans or any type of pants. The width of the garment is proportioned to the size of the wearer.

The body (12) of the insulating garment (10) is made up of at least one insulating material. The insulating material may be fleece or a fleece-like material. In a preferred embodiment, the garment has a multi-layer construction, with a water-repellent outer material, preferably twill, denim, rip-stop nylon or the like and an insulating core of fleece or one of the synthetic insulating materials such as Hollofil®, Quallofil® or Thermolite® by DuPont. The inner layer may be fleece, or the same material as the outer layer, or some other material, within the teachings of the invention.

The insulating garment (10) can be any of a variety of colors or patterns. As an example, for hunters, the outer layer of the insulating garment (10) can be made of camouflage material, to assimilate the insulating garment (10) with the hunter's surroundings. Such material is commercially available, such as Realtree® (Realtree Outdoor Products, Inc., Columbus, Ga.) or Trebark® (James Crumley, Roanoke Va.) fabric. If desired, fabric bearing two different camouflage patterns (or two different contrasting colors) may be used for the inner and outer layers, so that the garment may be reversed for use under differing conditions.

The body (12) has a shape which allows it to wrap comfortably around the hip region of the wearer. More specifically, the body (12) of the insulating garment (10) fully covers the buttocks on the backside of the wearer. The body (12) is extended to the front of the wearer so that the left edge (14) and the right edge (16) of the body (12) of the insulating garment (10) meet or overlap in the front of the wearer.

The upper and lower edges of the body (12) are formed by a waistband (20) and a hemline (22) substantially parallel to each other on the back and sides of the insulating garment (10). The waistband (20), is approximately level with one's waist when the garment is worn. The hemline (22) runs horizontally to surround the wearer's legs on the back and sides, and preferably stops at the mid-centerline of the leg, about three-quarters to the front of the insulating garment (10).

Toward the front center of the wearer's body, the hemline (22) is cut away (24), in preferably a substantially rectangular gap. The cut away area (24) allows for an individual to raise his legs while wearing the garment. It provides a solution to the restrictiveness in the prior art by supplying space in which a person can raise his legs, and subsequently sit down. There is no loss in insulation, as no new area is exposed to the air subsequent to putting on the insulating garment (10).

Above the cutaway (24), the hemline is cut back at an angle until it meets the right (14) and left (16) edges of the body (12). This creates an inverted v-shaped space (26) which allows an extended range of movement for the individual wearing the garment. In addition, the inverted v-shaped space allows unobtrusive access so that a male wearer can relieve himself without removing the insulating garment (10).

Preferably, the waistband (20) has a means for holding the garment at an individual's waist. This is preferably accomplished by incorporating belt loops (28) around the waistband, in a conventional manner as is used in pants. The number of belt loops is not essential, as long as there are enough belt loops to adequately support a belt. Alternatively, or in combination with the belt loops (28), an elastic material may be sewn into the waistband.

Where the left edge (16) and right edge (14) of the body (12) meet each other in the front of the garment, directly above the inverted v-shaped space (26), a fastener (34), such as a zipper, snaps, a hook and loop fabric fastener (e.g. VELCRO™), or buttons, may be used to hold the two side edges (14) and (16). The fastener (34) creates an easy way to take the insulating garment (10) on and off.

Optionally, at least one pocket (36) is provided on the insulating garment (10). The pocket(s) can be sewn into the body (12) on either side of the fastener (34), or may be located on the back or side of the insulating garment (10) (see FIG. 3). The size of the pocket (36) varies, and depends on the utility of the pocket on the individual insulating garment (10).

Figure 2A:
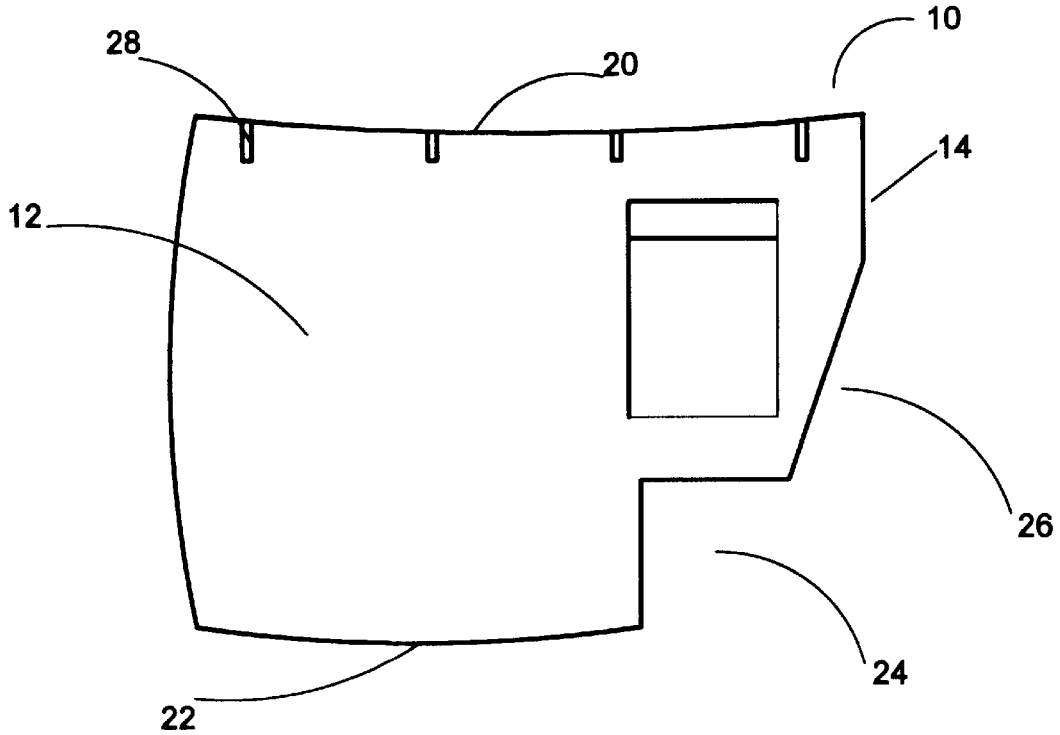
FIG. 2A and FIG. 2B show the side views of the garment of the present invention.
Figure 2B:
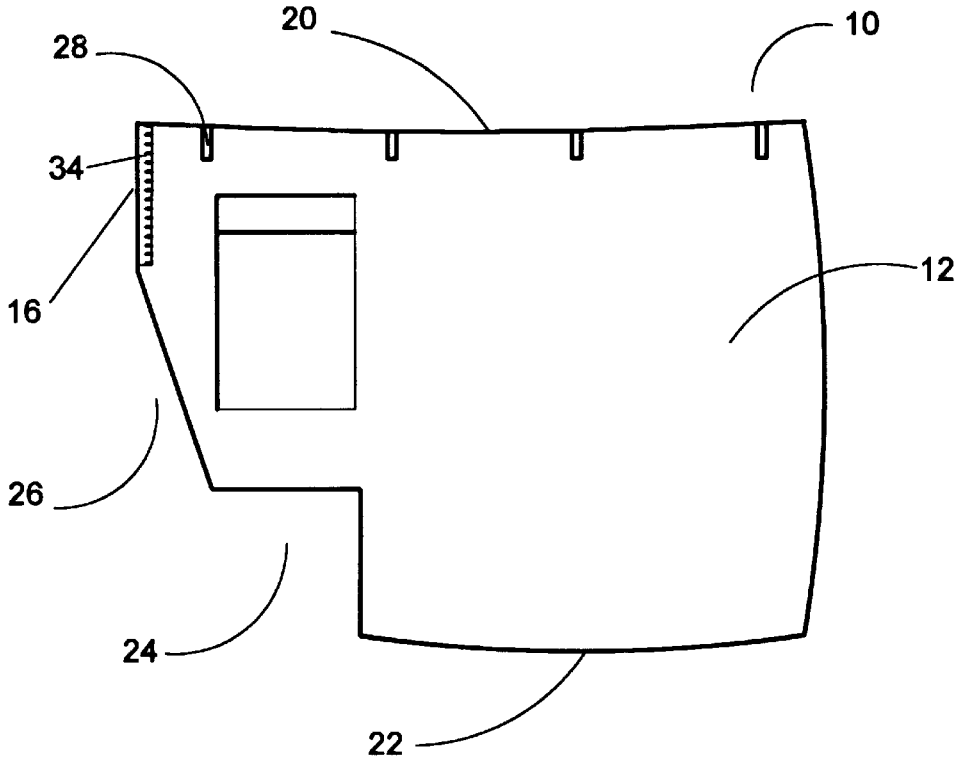

Referring to FIG. 2A and FIG. 2B, both side views are shown. The cutaway (24) extends out to part of each side of the garment, while the inverted v-shaped space (26) also affects the shape of the insulating garment (10) on the sides. Belt loops as the means for holding the garment in place at the waist (28) are shown in these views of the insulating garment (10).

Figure 3:
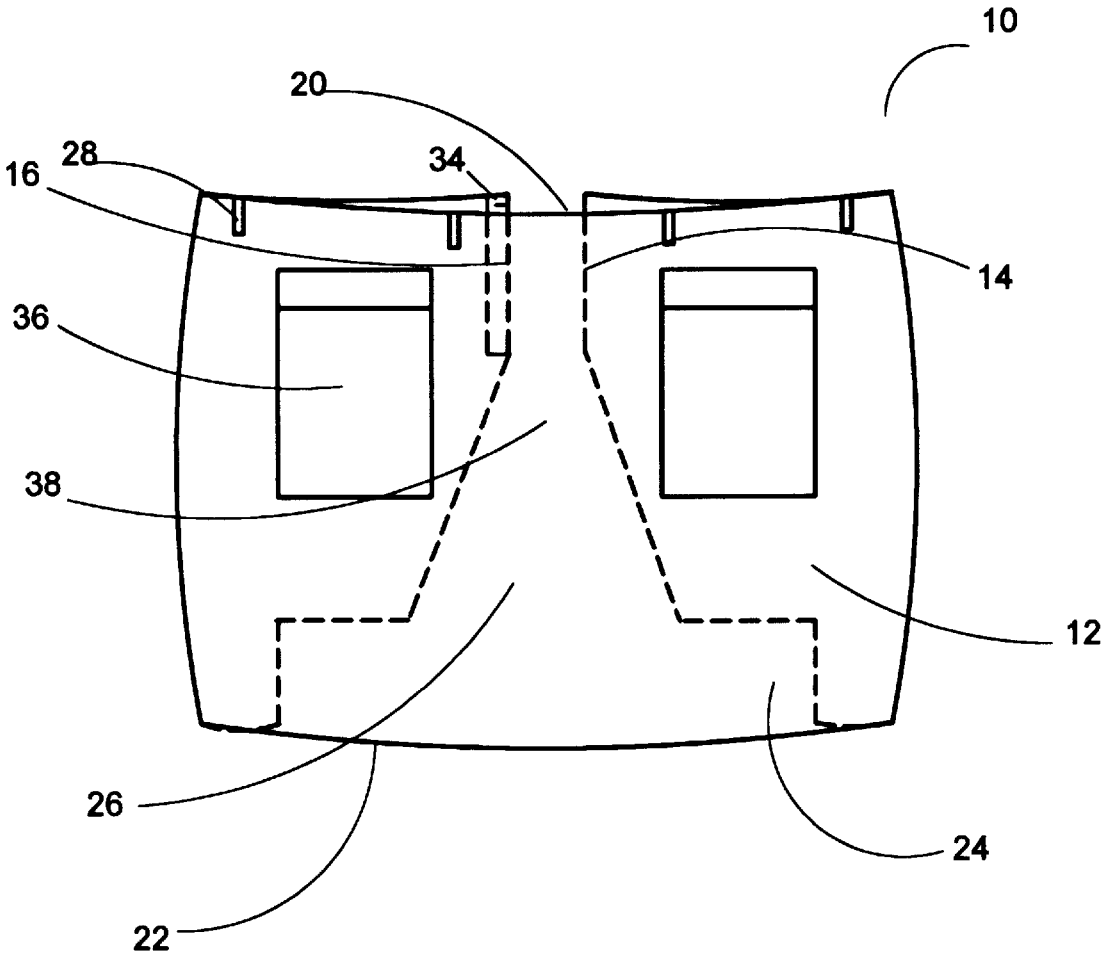
FIG. 3 shows a back view of the garment of the present invention.

Referring to FIG. 3, a back view of the insulating garment (10) is shown. Dashed lines depict the contour of the insulating garment (10) in the front view (see FIG. 1). In this view, it is seen that both the waistline (20) and the hemline (22) run substantially parallel along the entire length of the back of the insulating garment (10). The back of the insulating garment (10) is specifically designed to cover the entire buttocks region of the wearer.

This insulating garment (10) is practical for use on cold bleachers during a football game, during ice skating, hunting, or any other activities which require extra warmth around the hips without sacrificing comfort or range of movement.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An insulating garment for wearing around the waist of a wearer, covering the wearer from the wearer's waist to a point above the wearer's knees, including the wearer's upper thighs and buttocks, comprising a body having edges defined by a waistline, a right edge and a left edge generally perpendicular to the waistline, and a hemline generally parallel to the waistline;

the waistline having a length sufficient for wrapping around the waist of a wearer, such that when the garment is wrapped around the wearer's waist, the left edge and right edge at least meet in front of the wearer;

the waistline and the hemline being spaced apart at the rear of the wearer, such that when the garment is wrapped around the wearer's waist, the body covers the wearer's buttocks;

the hemline having a contour such that when the garment is wrapped around the wearer's waist, the hemline is parallel to the waistline along a line running from a first point at one thigh, around the wearer's buttocks to a second point on the other thigh, and at the first point and second point the hemline rises at an angle to the waistline to meet the left edge and right edge, forming a cutaway in front of the wearer;

wherein the contour of the hemline is shaped such that the hemline meets the right edge and left edge of the body at an acute angle.

2. The insulating garment of claim 1, in which the contour of the hemline is shaped such that at the first point and the second point the hemline rises on a line which is perpendicular to the waistline, then turns at a right angle for a distance, then turns at an oblique angle to meets the right edge and left edge of the body at an acute angle.

3. The insulating garment of claim 1 further comprising a plurality of belt loops adjacent to the waistline of said body of said insulating garment.

4. The insulating garment of claim 1 further comprising an elastic waistband around the waistline of said body of said insulating garment.

5. The insulating garment of claim 1 further comprising mating fasteners located adjacent to the left edge and right edge, such that the left edge and right edge may be fastened together.

6. The insulating garment of claim 5 wherein said mating fasteners are selected from the group consisting of zipper, snaps, buttons, and hook and loop fabric fasteners.

7. The insulating garment of claim 1 further comprising at least one pocket located on either side of the inverted v-shaped space on the front of the insulating garment.

8. The insulating garment of claim 1 further comprising at least one pocket on a back side of the insulating garment.

9. The insulating garment of claim 1 wherein said body is made of insulating material.

10. The insulating garment of claim 9 wherein said insulating material is a fleece material.

11. The insulating garment of claim 9 further comprising an outer layer comprising a water-repellent material.

12. The insulating garment of claim 11 wherein said water-repellent material is waterproof nylon.

* * * * *